US010479470B2

(12) United States Patent
Żuławski

(10) Patent No.: US 10,479,470 B2
(45) Date of Patent: Nov. 19, 2019

(54) ROTARY VANE STEERING GEAR

(71) Applicant: Sławomir Żuławski, Gdańsk (PL)

(72) Inventor: Sławomir Żuławski, Gdańsk (PL)

( * ) Notice: Subject to any disclaimer, the term of this patent is extended or adjusted under 35 U.S.C. 154(b) by 0 days.

(21) Appl. No.: 16/298,800

(22) Filed: Mar. 11, 2019

(65) Prior Publication Data

US 2019/0202540 A1 Jul. 4, 2019

Related U.S. Application Data

(63) Continuation of application No. PCT/PL2017/000091, filed on Sep. 22, 2017.

(30) Foreign Application Priority Data

Sep. 27, 2016 (PL) ..... P.418872

(51) Int. Cl.
*B63H 25/30* (2006.01)
*B63H 25/38* (2006.01)

(52) U.S. Cl.
CPC ..... *B63H 25/30* (2013.01); *B63H 25/38* (2013.01)

(58) Field of Classification Search
CPC ..... B63H 25/30; B63H 25/38
See application file for complete search history.

(56) References Cited

U.S. PATENT DOCUMENTS 2,793,623 A * 5/1957 Ludwig ..... F15B 15/12 277/357
4,919,040 A * 4/1990 Sollami ..... F01C 9/002 29/889.21
6,082,507 A * 7/2000 Forster ..... B60G 13/06 188/296
2004/0245019 A1* 12/2004 Hartwick ..... E21B 4/02 175/57
2008/0184950 A1* 8/2008 Lawrence ..... F01L 1/047 123/90.17

FOREIGN PATENT DOCUMENTS

EP 0 201 470 A1 11/1986
EP 1 437 296 A1 7/2004
JP 07132887 A 5/1995

OTHER PUBLICATIONS

International Search Report issued by the International Searching Authority for corresponding International Patent Application No. PCT/PL2017/000091 dated Dec. 8, 2017.
Written Opinion of the International Searching Authority for corresponding International Patent Application No. PCT/PL2017000091 dated Dec. 8, 2017.

* cited by examiner

*Primary Examiner* — Stephen P Avila
(74) *Attorney, Agent, or Firm* — Myers Wolin, LLC

(57) ABSTRACT

A rotary vane steering gear driven by a rotary vane hydraulic actuator, having a body confining an internal hydraulic space in the shape of toroid with a rotation axis (X-X). The body is divided by a plane (A-A) perpendicular to the rotation axis and in case of a circular torus shaped hydraulic space passing through the center point of the circle delimiting the space, the plane divides the space into a movable part (rotor 1.1) and a stationary part (stator 1.2). Both parts are bound by two thrust rings, that are fastened concentrically on the radially opposite sides of the hydraulic space, each to the respective edge of one body part and in radial overlap with the other body part, to create two concentric slewing bearings.

2 Claims, 4 Drawing Sheets

B–B

B–B

A–A

B–B

B–B

B–B

F–F

E–E

B–B

C–C

D–D

ROTARY VANE STEERING GEAR

CROSS REFERENCE TO RELATED APPLICATIONS

This application is a continuation under 35 U.S.C. § 120 of International Application PCT/PL2017/000091, filed Sep. 22, 2017, which claims priority to Polish Application No. P.418872, filed Sep. 27, 2016, the contents of each of which are incorporated by reference herein.

The present solution relates to a rotary vane steering gear that may be used in naval steering devices with hydraulic drive.

Certain embodiments herein can also be used in other devices where rotary reversible movement within a limited angle of rotation is required, for example opening/closing of butterfly valves.

BACKGROUND

State of the Art—FIG. 6 and FIG. 7

According to the state of the art, the closest design to certain embodiments herein is the rotary vane steering gear presented in FIG. 6 and FIG. 7.

State of the Art—Rotary Vane Steering Gear

The known rotary vane steering gears are driven by rotary vane hydraulic actuators which consist of a body (housing) that comprises the base 3.1, the cylindrical body 3.2, the cover 3.3 and the rotary hub 3.4. These parts enclose an internal hydraulic space described as a rectangular toroid, that is an object created by revolving a rectangle around revolution axis X-X coplanar with the rectangle and not crossing it. The cylindrical body 3.2, also named a stator, creates, in conjunction with the base 3.1 and the cover 3.3, the outer part of the actuator body, which is the stationary part, that does not perform any movement. The rotary hub 3.4 creates the inner part of the actuator body and is also named a rotor, since it is the movable part, that performs rotary reversible movement. The design of this actuator is characterized in that the body is divided by the cylindrical surface, that crosses the body parallelly to the revolution axis X-X, into the movable part—the rotor and the stationary part—the stator. The base 3.1 is made as one part with the cylindrical body 3.2 (the stator). The rotary hub 3.4 (the rotor) is mounted directly on the rudder stock 3.5 by the tapered keyed connection and fastened with the nut 3.6 in order to transmit the torque and the rotary movement onto the rudder stock 3.5.

The sequent components of the discussed actuator are the movable vanes 3.7 and the immovable vanes 3.8, of the space cross section, fastened alternately to the rotary hub 3.4 (the rotor) and the cylindrical body 3.2 (the stator) respectively. In most of the designs the immovable vanes 3.8 are fastened to the cylindrical body 3.2 (the stator) with the bolts 3.9. The movable vanes 3.7 can also be fastened with bolts or made as one part with the rotary hub 3.4 (the rotor), as it also is in the example. The number of vanes can be from one to several. In the discussed design two movable vanes 3.7 and two immovable vanes 3.8 are installed alternately, to divide the internal hydraulic space for four hydraulic chambers: 3.10*a*, 3.10*b*, 3.10*c* and 3.10*d*.

The cover 3.3 is fastened to the cylindrical body 3.2 (the stator) with the bolts 3.11. The base 3.1 is fastened to the foundation 3.12 with the bolts 3.13. Between the rotary hub

3.4 (the rotor) and the cover 3.3 and the base 3.1 there are placed respectively: upper radial bearing 3.14*a*, lower radial bearing 3.14*b* and axial bearing 3.15, also called thrust bearing. The vanes are equipped with the seals 3.16, to seal the hydraulic chambers between the vanes. Between the cover 3.3 and the rotary hub 3.4 (the rotor) and also between the base 3.1 and the rudder stock 3.5 there are placed the hydraulic space seals: upper 3.17*a* and lower 3.17*b* respectively, to seal the whole hydraulic space from surroundings.

Pumping of hydraulic oil or other medium by the pump 3.18 through the distributor 3.19 and then the piping 3.20*a* or 3.20*b* to the respective hydraulic chambers 3.10*a* and 3.10*c* or 3.10*b* and 3.10*d* causes rotary movement of the movable vanes 3.7 in conjunction with the rotor 3.4 and stock 3.5 around rotation axis X-X, while the base 3.1, stator 3.2 and cover 3.3 remain immovable. By the position of the distributor 3.19 shown in FIG. 7, the pump 3.18 pumps the medium through piping 3.20*a* to chambers 3.10*a* and 3.10*c*, what causes clockwise rotation of the movable vanes 3.7 and hub 3.4 with stock 3.5 in relation to the stator 3.2. The medium from the hydraulic chambers 3.10*b* and 3.10*d* is pressed by movable vanes 3.7 through piping 3.20*b* and distributor 3.19 to the tank 3.21.

SUMMARY

A rotary vane steering gear includes a rotary vane hydraulic actuator that has a body divided into a movable part that creates the rotor and a stationary part that creates a stator where both parts together confine the internal hydraulic space in the shape of a toroid with a rotation axis (X-X), and a rudder stock placed in the rotation axis (X-X), wherein the body is divided by plane (A-A) that crosses a space perpendicularly to the rotation axis (X-X) and in case of a space of circular toroid shape—by plane (A-A) that crosses the space perpendicularly to the rotation axis (X-X) and a center point of a circle delimiting the space, into the rotor (1.1) and the stator (1.2) bound by two thrust rings (1.7*a*) and (1.7*b*) that are fastened concentrically on both opposite sides of hydraulic space each to the respective edge of one body part and that overlap the other body part radially, to create in conjunction with the both body parts two concentric slewing bearings that keep the rotor (1.1) and the stator (1.2) in one axial and radial position to each other and enable the rotor to rotate in relation to the stator around the rotation axis (X-X).—

DETAILED DESCRIPTION

A rotary vane steering gear driven by the rotary vane hydraulic actuator, is characterized in that the actuator body, confining internal hydraulic space in the shape of toroid with the rotation axis X-X, is divided by plane (A-A), that crosses the space perpendicularly to the rotation axis (X-X) and in case of the space of circular toroid shape (torus)—by plane (A-A) that crosses the space perpendicularly to the rotation axis (X-X) and the center point of the circle delimiting the space, into the movable part 1.1—the rotor and the stationary part 1.2—the stator bound by two thrust rings (17*a*) and (1.7*b*), that are fastened concentrically on the both opposite sides of the hydraulic space each to the respective edge of one body part and that overlap the other body part radially, to create in conjunction with both body parts two concentric slewing bearings that keep both body parts in one axial and radial position and enable the rotor to rotate in relation to the stator around the rotation axis X-X.

Figure 8:
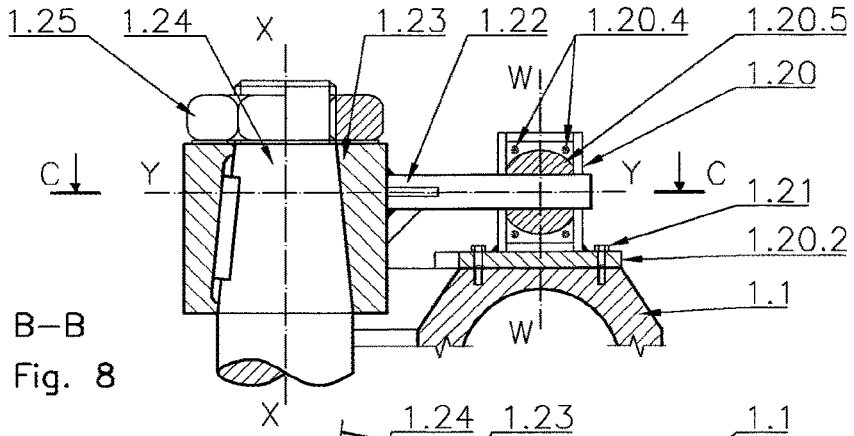
FIG. 8: Vertical view—section B-B of an example construction of the sliding-swinging connection 1.20 (yoke)
Figure 9:
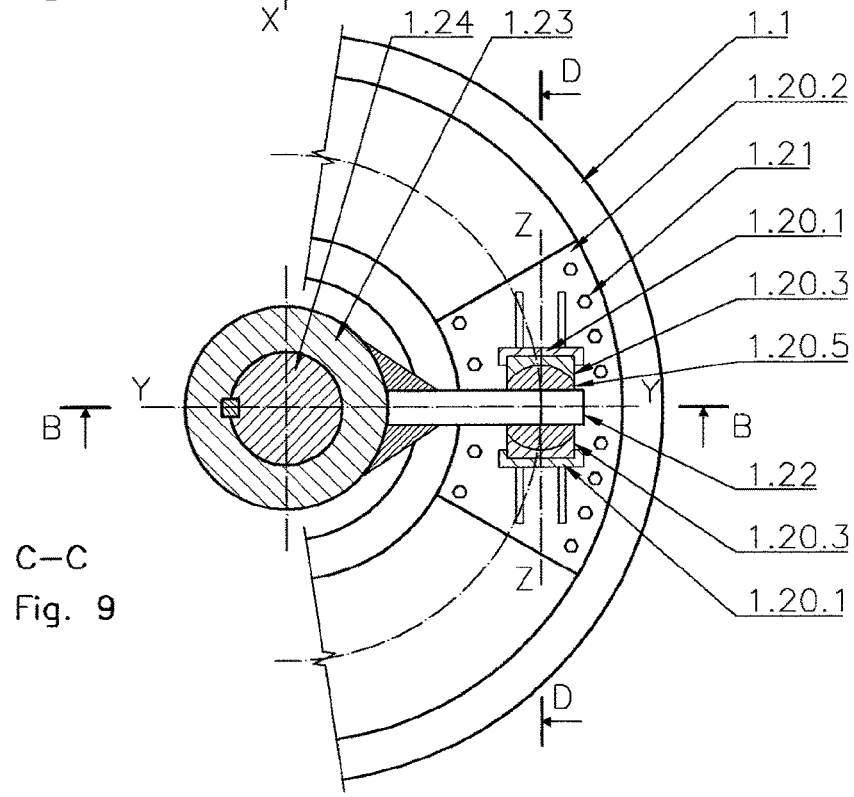
FIG. 9: Plane view—section C-C of an example construction of the sliding-swinging connection 1.20 (yoke)
Figure 10:
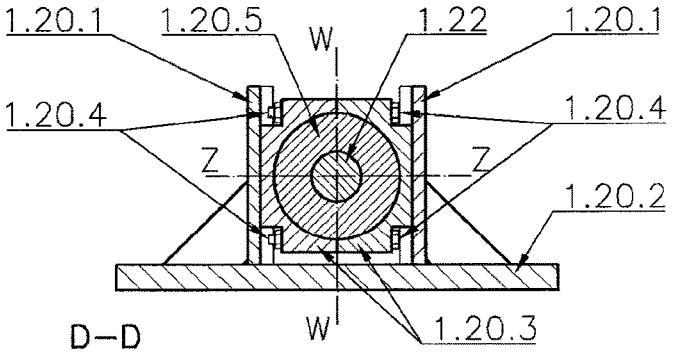
FIG. 10: Vertical view—section D-D of an example construction of the sliding-swinging connection 1.20 (yoke)

As presented in FIGS. 8-10, in that the connection of the actuator rotor 1.1 with the rudder stock 1.24, that is placed in the rotation axis X-X, is effected by the tiller arm 1.22 one end of which is attached to the hub 1.23 mounted on the rudder stock while the other end is embedded slidingly in the opening of the sphere bearing 1.20.5, with the sliding axis Y-Y perpendicular to the rotation axis X-X, that is placed inside the sliding block 1.20.3 embedded slidingly between the guides 1.20.1, which are fastened to the actuator rotor 1.1 and enable the sliding block to move only along the sliding axis W-W parallel to the rotation axis X-X and perpendicular to the axis Y-Y. The sphere bearing 1.20.5, sliding block 1.20.3 and guides 1.20.1 are parts of the sliding-swinging connection 1.20 (the yoke), construction of which is described further in the specification.

With regard to the division of the body by the plane A-A that crosses the internal hydraulic space perpendicularly to the rotation axis X-X, the body of the hydraulic actuator consists of the following two parts: the body upper part 1.1 (also the upper part of the body) and the body lower part 1.2 (also the lower part of the body). In the discussed design the body upper part 1.1 can be named the rotor, because it is the part of the body that performs rotary movement, and the body lower part 1.2 can be named the stator, because it is the stationary part of the actuator body that is fastened to the foundation 1.3 with the bolts 1.4 and does not perform any movement.

Figure 3:
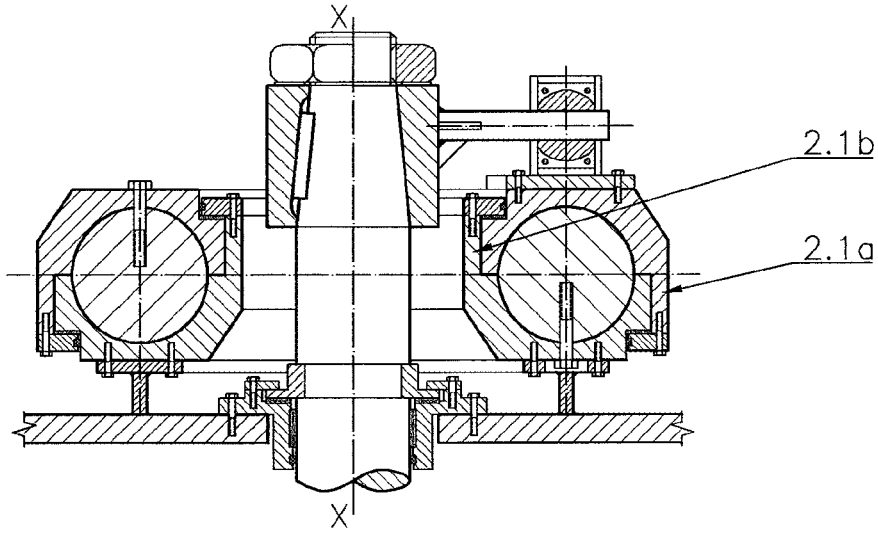
FIG. 3: Scheme of certain embodiments in which both body parts have one each the raised side edge, item 2.1*a* and 2.1*b;*

In the body upper part 1.1 (the rotor) there are two cylindrical side edges, the outer 1.5*a* and the inner 1.5*b*, that are raised concentrically on the both opposite sides of the hydraulic space beyond the division plane A-A and overlap the lower body part 1.2 (the stator) along axis X-X (axially). Certain embodiments can be designed in such a way that both body parts contain one each the raised side edge that axially overlaps the other body part, what is shown in FIG. 3, item 2.1*a* and 2.1*b*. Both side edges 1.5*a* and 1.5*b* create in conjunction with the body lower part 1.2 (the stator) two radial bearings: the outer 1.6*a* and the inner 1.6*b*.

Figure 4:
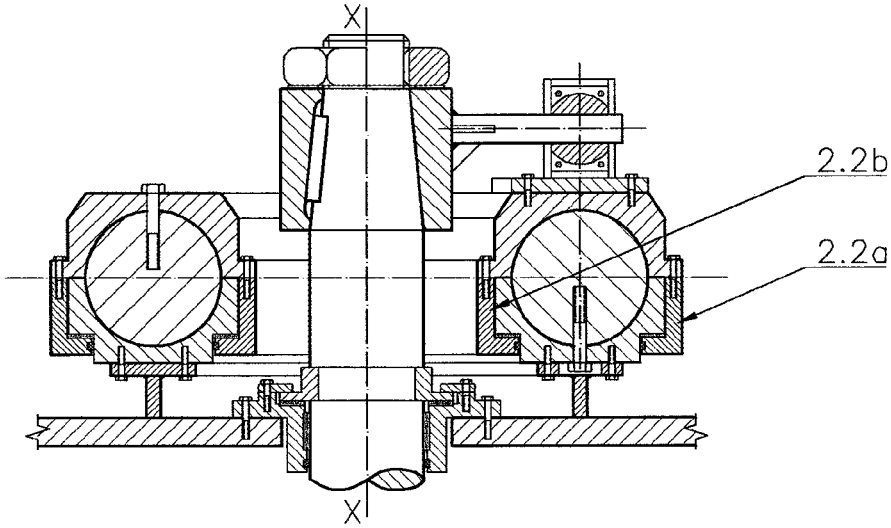
FIG. 4: Scheme of certain embodiments in which side edges are part of the thrust rings, item 2.2*a* and 2.2*b;*

The sequent characteristic components are two thrust rings: the outer 1.7*a* and the inner 1.7*b*, that are fastened with the bolts 1.8 to the raised side edges 1.5*a* and 1.5*b* respectively. The thrust rings 1.7*a* and 1.7*b* are fastened concentrically to one of the body parts and overlap radially the other body part, hence one body part embraces the other body part and keeps both body parts in the same equal distance in relation to each other along the rotation axis X-X. Certain embodiments can be designed in such a way that the thrust rings contain the cylindrical side edges, what is shown in FIG. 4, item 2.2*a* and 2.2*b*. The thrust rings form with the body lower part 1.2 (the stator) two lower axial bearings: the outer 1.9*a* and the inner 1.9*b*, which carry over loads from axial forces pushing away the both body parts from each other, that are caused by the pressure existing inside the actuator, and enable the rotor to rotate in relation to the stator around the rotation axis X-X.

Between the body upper part 1.1 (the rotor) and the body lower part 1.2 (the stator) there are located, at the division plane A-A, two upper axial bearings: the outer 1.10*a* and the inner 1.10*b*, which carry over loads also from axial forces existing between both body parts, but of the opposite direction to the forces carried over by bearings 1.9*a* and 1.9*b*.

In other words, the side edges 1.5*a* and 1.5*b*, in conjunction with the thrust rings 1.7*a* and 1.7*b*, which are fastened to them respectively, form together with the both body parts and on the both opposite sides of the hydraulic space two concentric slewing bearings: the outer and the inner, each one of them consisting of one radial bearing 1.6*a*, 1.6*b* respectively, and two axial bearings 1.9*a*, 1.9*b* and 1.10*a*, 1.10*b* respectively. Both slewing bearings keep the both body parts in one axial and radial position and enable them to move in relation to each other only by rotating movement around the common rotation axis X-X.

Both body parts confine together internal toroidal hydraulic space, that is the space created by revolving a figure, a circle or rectangle, around axis X-X coplanar with the plane B-B of the figure and not crossing it. In the discussed design shown in FIGS. 1, 3 and 4 the internal space is created by revolution of a circle around axis X-X, and so it delimits circular toroid (torus). However, the internal space can be also created by revolution of a rectangle and then it delimits rectangular toroid, which is presented in FIG. 5, item 2.3.

Inside the internal toroidal space there are placed the movable vanes 1.11*a* (the rotor vanes) and the immovable vanes 1.11*b* (the stator vanes), of the space cross section, which are fastened with the bolts 1.12 alternately to the body upper part 1.1 (the rotor) and the body lower part 1.2 (the stator) respectively. The number of the vanes can be varied from one to several. In the discussed design shown in FIG. 2 two vanes are fastened alternately to each body part, thus four vanes in total, to divide the internal hydraulic space for four separate hydraulic chambers, designated respectively: 1.13*a*, 1.13*b*, 1.13*c*, 1.13*d*. The opposite located hydraulic chambers: 1.13*a* with 1.13*c* and 1.13*b* with 1.13*d*, are connected by the piping 1.14*a* and 1.14*b* respectively. The vanes may be equipped with the seals 1.15, to seal the hydraulic chambers between the vanes.

Figure 2:
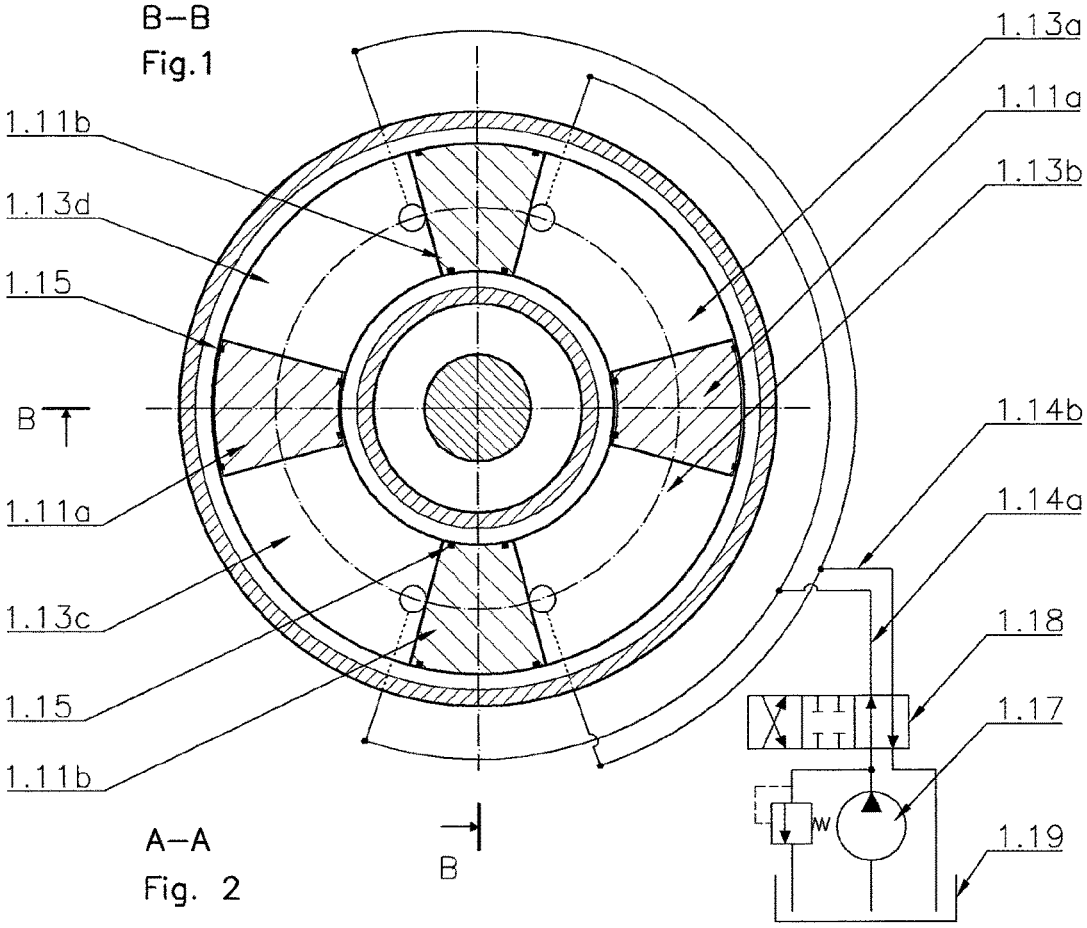
FIG. 2: General scheme of certain embodiments in plane view—section A-A, in conjunction with the scheme of hydraulic system.

Between thrust rings 1.7*a* and 1.7*b* and the body lower part 1.2 (the stator) there may be placed the hydraulic space seals: the outer 1.16*a* and the inner 1.16*b* respectively, to seal the whole hydraulic space from surroundings. Pumping the medium, as shown in FIG. 2, by the pump 1.17 through the distributor 1.18 and the piping 1.14*a* to the chambers 1.13*a* and 1.13*c*, causes the rotary movement of the movable vanes 1.11*a* with the rotor 1.1 in clockwise direction around axis X-X in relation to the stator 1.2. As the result of the movement of the movable vanes the medium from the chambers 1.13*b* and 1.13*d* flows through the piping 1.14*b* and the distributor 1.18 to the tank 1.19.

The rotary movement of the rotor 1.1 is transmitted through the sliding-swinging connection 1.20 (the yoke), that is fastened to the rotor (1.1) with the bolts 1.21, onto the tiller arm 1.22 embedded into the yoke 1.20 with one end. The other end of the tiller arm 1.22 is attached to the hub 1.23 mounted on the shaft 1.24 and fastened with the nut 1.25.

An example scheme of construction of the sliding-swinging connection 1.20 (yoke) is shown in FIGS. 8, 9 and 10. The yoke 1.20 consists of two guides 1.20.1 attached to the connection base 1.20.2, which is fastened with bolts 1.21 to the rotor 1.1. Between the guides 1.20.1 there is placed the sliding block 1.20.3 consisting of two parts that are fastened to each other with the bolts 1.20.4. Both parts of the sliding block 1.20.3 confine together internal spherical space in which there is placed the sphere bearing 1.20.5, that can also be named the self-aligning bearing and that contains the opening of sliding axis Y-Y perpendicular to the rotation axis X-X.

One end of the tiller arm 1.22 may be embedded slidingly in the opening of the sphere bearing 1.20.5, while the other end is attached to the hub 1.23, which is mounted on the rudder stock 1.24 by tapered keyed connection and fastened with the nut 1.25. The tiller arm 1.22 can move inside the opening of the sphere bearing 1.20.5 in relation to the yoke 1.20, and thus in relation to the rotor 1.1, along the axis Y-Y. The sliding block 1.20.3 can move between the guides 1.20.1 along the axis W-W, that is parallel to the axis X-X and perpendicular to the axis Y-Y. The sphere bearing 1.20.5 can rotate inside the sliding block 1.20.3 around cross point of the axes Y-Y and W-W, which is the center point of the spherical surface of the sphere bearing 1.20.5. With regard to the connection of the rotor 1.1 with the tiller arm 1.22 through the yoke 1.20, the rudder stock 1.24 with the hub 1.23 and the tiller arm 1.22 can move and incline (rotate) in relation to the rotor 1.1. In other words, the rotation axis of the rudder stock does not need to be aligned with the rotation axis X-X of the actuator rotor but can be shifted and inclined (rotated) in relation to this axis.

ADVANTAGES OF CERTAIN EMBODIMENTS

The division of the body into two parts by plane A-A, that crosses the internal hydraulic space perpendicularly to the rotation axis X-X and the centre point of the figure delimiting the space, enables to form this space as circular toroid (torus), that is an object created by revolving a circle around the axis X-X coplanar with the plane B-B of the circle and not crossing it. With regard to that the vanes can also be of circular cross section, which may be more optimal in comparison to rectangular cross section because, among other features, of the lower circumference to area ratio of the circle in relation to the rectangle.

The sequent advantage to certain embodiments is the result of that the circular cross section of the vanes allows to use the circular seals on the vanes that results in more effective sealing of the hydraulic chambers between the vanes than in case of rectangular vanes. This may enable applying higher pressure inside the element with circular vanes than in the case of the element with rectangular vanes.

The next advantage to certain embodiments results from that the rotor of the rotary vane hydraulic actuator is not mounted directly on the rudder stock but is separated from the rudder stock and transmits the torque and the rotary movement on the rudder stock through the tiller arm, that is attached with one end to the hub mounted on the rudder stock while the other end is embedded into sliding-swinging connection (yoke), that is fastened to the actuator rotor. Such connection of the rudder stock with the rotary actuator may be tolerant for possible defects in manufacturing or installation, as for example eccentricity between rotation axis of the rudder stock and of the rotary vane actuator, and allows displacements of the rudder stock in relation to the rotary actuator, that results for example from thermal expansibility, deflection of foundation or wearing off material in bearings. With regard to this the rotary actuator transmits on the rudder stock, or reversely—the stock on the actuator, only the torque and the rotary movement around the rotation axis X-X and not other loads and displacements that would have detrimental influence on the working of the steering gear.

LIST OF FIGURES, PARTS AND REFERENCE NUMERALS

Figure 1:
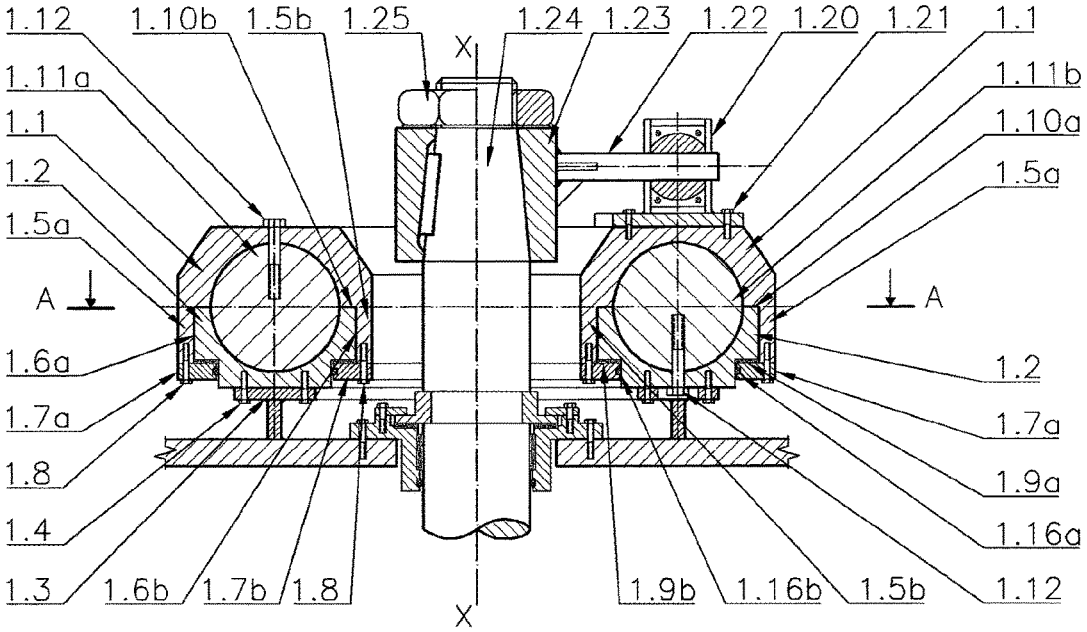
FIG. 1: General scheme of certain embodiments in a vertical view—section B-B.

First Drawing:

FIG. 1: General scheme of a solution in vertical view—section B-B.

FIG. 2: General scheme of a solution in plane view—section A-A, in conjunction with the scheme of hydraulic system.

Designation of the Items:

1.1 Body upper part (movable part—rotor) of rotary vane hydraulic actuator
1.2 Body lower part (stationary part—stator) of rotary vane hydraulic actuator
1.3 Foundation
1.4 Bolts fastening lower part 1.2 (stator) to foundation 1.3
1.5*a* Outer side edge
1.5*b* Inner side edge
1.6*a* Outer radial bearing
1.6*b* Inner radial bearing
1.7*a* Outer thrust ring
1.7*b* Inner thrust ring
1.8 Bolts fastening thrust rings to side edges
1.9*a* Outer lower axial bearing
1.9*b* Inner lower axial bearing
1.10*a* Outer upper axial bearing
1.10*b* Inner upper axial bearing
1.11*a* Movable vanes (rotor vanes)
1.11*b* Immovable vanes (stator vanes)
1.12 Bolts fastening vanes to the body parts
1.13*a, b, c, d* Hydraulic chambers between vanes
1.14*a, b* Piping
1.15 Vane seals
1.16*a* Hydraulic space outer seal
1.16*b* Hydraulic space inner seal
1.17 Pump
1.18 Distributor
1.19 Tank
1.20 Sliding-swinging connection (yoke)
1.21 Bolts fastening connection 1.20 to rotor 1.1
1.22 Tiller arm
1.23 Hub
1.24 Rudder stock
1.25 Nut fastening hub 1.23 to shaft 1.24

Second Drawing

FIG. 3: Scheme of a solution in which both body parts have one each the raised side edge, item 2.1*a* and 2.1*b*.

FIG. 4: Scheme of a solution in which the side edges are part of the thrust rings, item 2.2*a* and 2.2*b*.

Figure 5:
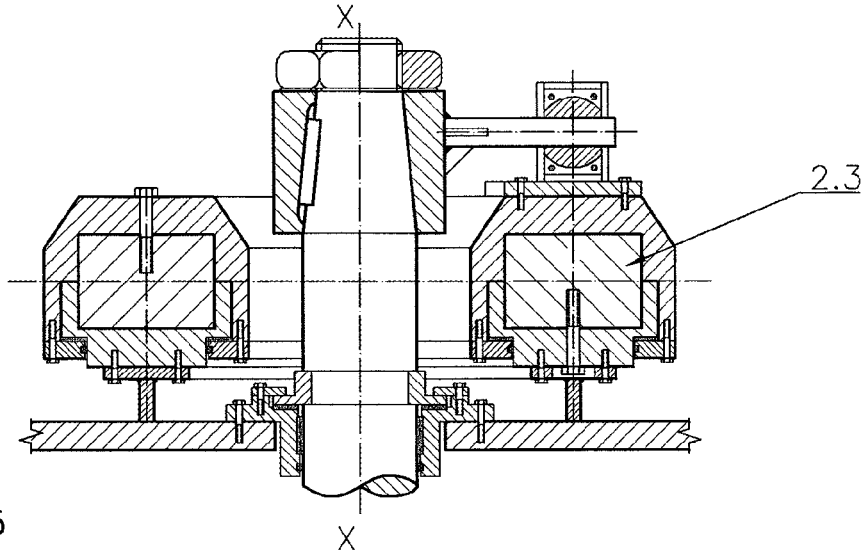
FIG. 5: Scheme of certain embodiments with an internal toroidal hydraulic space of rectangular cross section, item 2.3.

FIG. 5: Scheme of a solution with the internal toroidal hydraulic space of rectangular cross section, item 2.3.

Third Drawing

State of the art—Rotary vane steering gear

Figure 6:
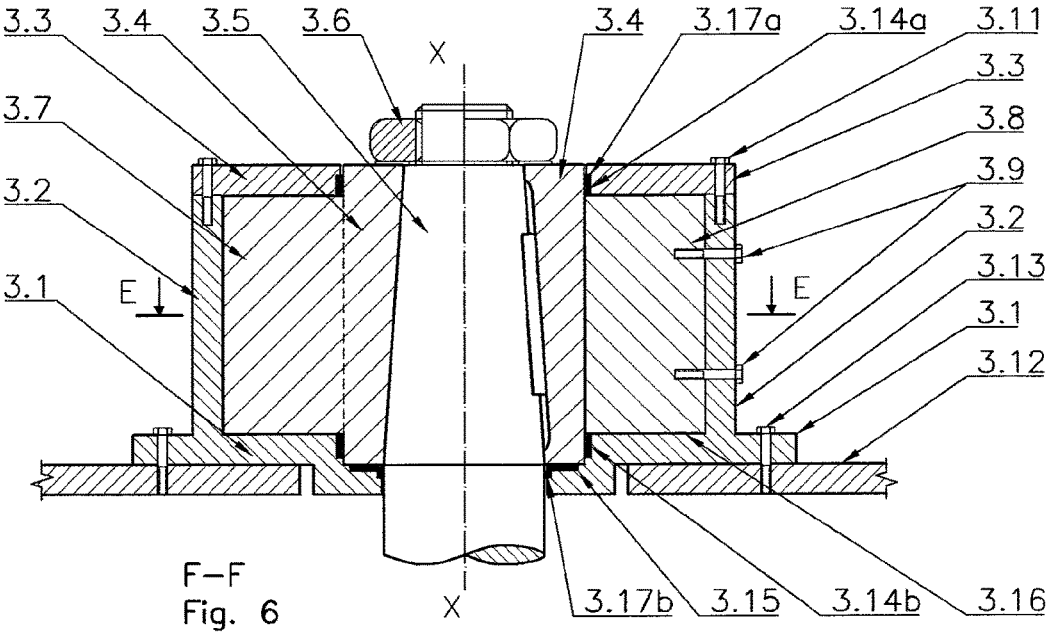
FIG. 6: Vertical view—section F-F.

FIG. 6: Vertical view—section F-F.

Figure 7:
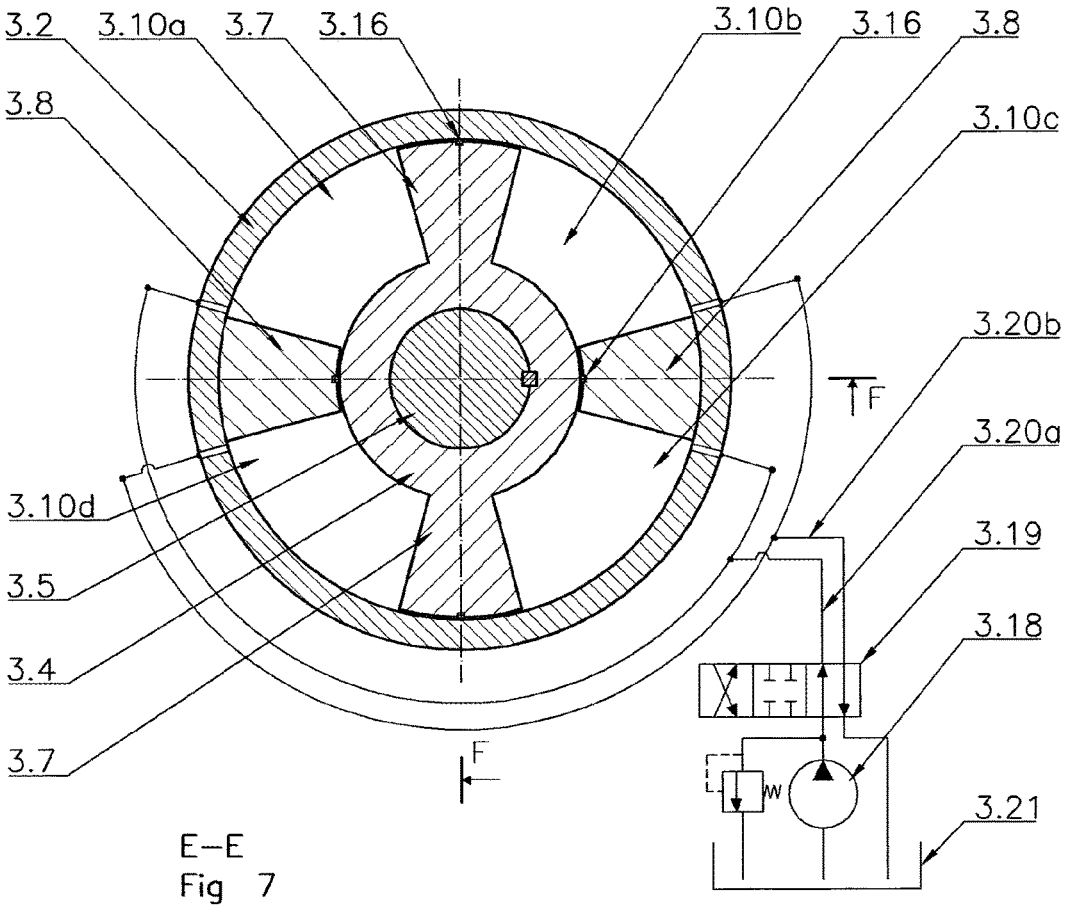
FIG. 7: Plane view—section E-E.

FIG. 7: Plane view—section E-E.

Designation of the Parts:

3.1 Base
3.2 Cylindrical body (stator)
3.3 Cover
3.4 Rotary hub (rotor)
3.5 Rudder stock
3.6 Nut fastening hub 3.4 to rudder stock 3.5
3.7 Movable vanes (rotor vanes)
3 8 Immovable vanes (stator vanes)
3.9 Bolts fastening immovable vanes 3.8 to the body 3.2
3.10*a, b, c, d* Hydraulic chambers between vanes
3.11 Bolts fastening cover 3.3 to the body 3.2
3.12 Foundation
3.13 Bolts fastening base 3.1 to foundation 3.12
3.14*a* Upper radial bearing
3.14*b* Lower radial bearing
3.15 Axial bearing (thrust bearing)
3.16 Vane seals
3.17*a* Hydraulic space upper seal
3.17*b* Hydraulic space lower seal
3.18 Pump
3.19 Distributor
3.20*a, b* Piping
3.21 Tank Fourth Drawing Example construction of the sliding-swinging connection 1.20 (yoke)

FIG. 8: Vertical view—section B-B.

FIG. 9: Plane view—section C-C.

FIG. 10: Vertical view—section D-D.

Designation of the Parts:

1.1 Body upper part (movable part/rotor) of rotary vane hydraulic actuator
1.20 Sliding-swinging connection (yoke), consisting of following parts:
1.20.1 Guides (consisting of two parts)
1.20.2 Base of sliding-swinging connection
1.20.3 Sliding block (consisting of two parts)
1.20.4 Bolts fastening both parts of sliding block 1.20.3
1.20.5 Sphere bearing inside sliding block 1.20.3
1.21 Bolts fastening connection 1.20 to rotor 1.1
1.22 Tiller arm
1.23 Hub
1.24 Rudder stock
1.25 Nut fastening hub 1.23 to rudder stock 1.24

The invention claimed is:

1. A rotary vane steering gear comprising a rotary vane hydraulic actuator that has a body divided into a movable part that creates the rotor and a stationary part that creates a stator where both parts together confine the internal hydraulic space in the shape of a toroid with a rotation axis (X-X), and a rudder stock placed in the rotation axis (X-X), wherein the body is divided by plane (A-A) that crosses a space perpendicularly to the rotation axis (X-X) and in case of a space of circular toroid shape—by plane (A-A) that crosses the space perpendicularly to the rotation axis (X-X) and a center point of a circle delimiting the space, into the rotor and the stator bound by two thrust rings and that are fastened concentrically on both opposite sides of hydraulic space each to the respective edge of one body part and that overlap the other body part radially, to create in conjunction with the both body parts two concentric slewing bearings that keep the rotor and the stator in one axial and radial position to each other and enable the rotor to rotate in relation to the stator around the rotation axis (X-X).

2. The rotary vane steering gear comprising:

a rotary vane hydraulic actuator that has a body divided into a movable part that creates a rotor and a stationary part that creates a stator, where both parts together confine the internal hydraulic space in a shape of a toroid with a rotation axis (X-X), and a rudder stock placed in the rotation axis (X-X), wherein a transmission of a torque and a rotary movement from an actuator rotor onto the rudder stock is effected by a tiller arm one end of which is attached to a hub mounted on a rudder stock while the other end is embedded slidingly in an opening of a sphere bearing, with a sliding axis (Y-Y) perpendicular to the rotation axis (X-X), that is placed in a sliding block (embedded slidingly between guides, which are attached to the actuator rotor and enable the sliding block to move only along sliding axis (W-W) parallel to the rotation axis (X-X) and perpendicular to the axis (Y-Y).

* * * * *